US005524325A

United States Patent [19]

Pierce

[11] Patent Number: 5,524,325

[45] Date of Patent: Jun. 11, 1996

[54] GIN STAND HEAT DETECTION APPARATUS

[76] Inventor: Glenn E. Pierce, P.O. Box 656, Rayville, La. 71269

[21] Appl. No.: 491,730

[22] Filed: Jun. 19, 1995

[51] Int. Cl.[6] ..... D01G 31/00

[52] U.S. Cl. ..... 19/0.22; 19/0.2; 19/48 R; 19/55 R; 19/63

[58] Field of Search ..... 19/0.20, 0.21, 19/0.22, 5 R, 24, 39, 48 R, 54, 55 R, 62 R, 63

[56] References Cited

U.S. PATENT DOCUMENTS

| | | | |
|---|---|---|---|
| 2,769,208 | 11/1956 | Deems | 19/55 R |
| 3,160,922 | 12/1964 | Neitzel et al. | 19/0.22 |
| 5,131,515 | 7/1992 | Scamardo | 19/0.20 |

*Primary Examiner*—John J. Calvert
*Attorney, Agent, or Firm*—John M. Harrison

[57] ABSTRACT

A gin stand heat detection apparatus which includes a pair of infrared thermocouples typically mounted on the main frame weldment of a gin assembly in facing relationship beside the saw cylinder assembly and the doffing roller, for monitoring the temperature of the saw blades and ginning ribs in the saw cylinder assembly. The infrared thermocouples are electrically connected to a control panel, which control panel is, in turn, typically connected to a conventional gin stand control panel. The infrared thermocouple control panel includes a visual alarm system for notifying an operator that a high temperature condition exists at any point along the saw blades and interspaced ginning ribs between the facing infrared thermocouples. The apparatus is also capable of automatically separating the saw blades and ginning ribs in case of a high temperature event.

18 Claims, 1 Drawing Sheet

GIN STAND HEAT DETECTION APPARATUS

BACKGROUND OF THE INVENTION

FIELD OF THE INVENTION

This invention relates to temperature monitoring and control systems for cotton gins and more particularly, to an infrared thermocouple temperature monitoring and control system which operates to notify an operator of a high temperature condition existing at any point along the saw blades and interspaced ginning ribs of the cotton gin saw cylinder assembly. In a preferred embodiment the gin stand heat detection apparatus of this invention is characterized by a pair of infrared thermocouples mounted in spaced, facing relationship in the gin weldment at each end of the saw cylinder assembly of a gin assembly, such that a high temperature condition existing in any one of the saw blades and interspaced ginning ribs of the saw cylinder assembly is detected by the facing infrared thermocouples. The infrared thermocouples are electrically connected to a control panel which includes a set of controls and a visual alarm system for each infrared thermocouple. The infrared thermocouple control panel is also typically electrically connected to the conventional gin stand control panel for terminating operation of the cotton gin in the event of a high temperature condition in the saw cylinder assembly. In a most preferred embodiment of the invention the infrared thermocouples are mounted by means of removable brackets in the main frame weldment of the gin assembly, which main frame weldment also rotatably receives the saw cylinder assembly, the adjacent doffing roller and the fixed ginning ribs, the latter of which register with the saw blades in the saw cylinder assembly. The infrared thermocouple sensors of this invention are unpowered and can measure the surface temperature of materials without touching the materials. The infrared detection elements in the sensors receive heat energy radiated from the objects monitored and convert the heat passively to an electrical potential. A millivolt signal is produced in the sensor and is scaled to the desired thermocouple characteristic. The sensors are solid, hermetically sealed, fully potted systems that do not change either mechanically or metallurgically during service.

In a cotton gin, lint is pulled and separated from the cotton seed by gin saw blades rotating between spaced, fixed ginning ribs. The saw teeth carry the lint through the evenly spaced ginning ribs at the ginning point and the seed is left behind in a roll box. The lint is removed from the saw by a doffing brush mounted on a doffing roller. The gin is typically fitted with 161 saw blades, rotating at a speed of 615 rpm and the saw blades usually have 330 teeth, on 16 inch diameter blades.

One of the problems which has long existed in cotton gins is that of fires which develop when individual tufts or clumps of cotton, commonly called "tags", are trapped between the respective saw blades of the saw cylinder assembly and the corresponding fixed ginning ribs, which are deployed between the individual saw blades of the gin saw. The friction between the tags, rotating saw blades and ginning ribs quickly causes the saw blades and ginning ribs to overheat and warp and sometimes causes a fire in the saw cylinder assembly. Since there is a considerable amount of lint cotton in this lint separation area and air is blown through the cotton gin to aid in the lint separation process, the fire may quickly spread and can easily consume the entire cotton gin. Attempts to provide an early detection system for determining the location of these "hot spots" caused by cotton tags, include using a meter relay to detect the increase in amperage loads on the gin motor when a tag overloads the saw blades. However, the time lag from the onset of the "hot spot" and the detectability of this increase in the amperage load is such that frequently, fires start before the meter relay detection system is operable to detect the problem. In addition to causing fires, such tags can also break or warp the respective ginning ribs extending between the saw cylinder blades, or warp the saw blades themselves and under these circumstances, the entire saw cylinder assembly must be replaced. It has been estimated that 85% of the fires which begin in cotton gins are caused by such tags.

Accordingly, it is an object of this invention to provide a new and improved gin stand heat detection apparatus which is characterized by a pair of infrared thermocouples mounted at each end of the saw cylinder assembly between the saw cylinder assembly and the doffing roller, in facing, spaced relationship with respect to each other for detecting a temperature increase in the saw blades and ginning ribs.

Another object of this invention is to provide a new and improved gin stand heat detection apparatus which includes a pair of infrared thermocouples mounted on the main frame weldment of a gin assembly in facing relationship at each end of the saw cylinder assembly for detection of temperature increases in the saw blades and ginning ribs of the saw cylinder assembly responsive to the entanglement of cotton tags between the rotating saw blades and the ginning ribs.

Yet another object of this invention is to provide a new and improved gin stand heat detection apparatus which includes a pair of infrared thermocouples attached by means of brackets to the main frame weldment of a gin assembly in spaced, facing relationship with respect to each other at each end of the saw cylinder assembly. The infrared thermocouples are connected to a control panel for detecting, displaying and monitoring an increase in the temperature of the saw blades and ginning ribs when cotton tags are randomly and inadvertently lodged between the saw blades and the ginning ribs to create "hot spots" in the saw cylinder assembly.

SUMMARY OF THE INVENTION

These and other objects of the invention are provided in a new and improved gin stand heat detection apparatus which, in a preferred embodiment, is characterized by a pair of infrared thermocouples attached to brackets removably mounted in the main frame weldment of a gin assembly and disposed in facing, spaced relationship at each end of the saw cylinder assembly and adjacent to the doffing roller. As so mounted, the infrared thermocouples monitor a cylindrical or cone-shaped area parallel to the saw cylinder assembly and the doffing roller, including the saw blades and the ginning ribs, to detect "hot spots" in the saw blades and the ginning ribs resulting from tags of cotton lodging between the saw blades and the ginning ribs. Further included is a dual thermocouple control panel electrically connected to the infrared thermocouples and the cotton gin control system for monitoring the temperature of the respective saw blades and ginning ribs, providing an alarm for the operator and conditionally terminating operation of the cotton gin.

BRIEF DESCRIPTION OF THE DRAWINGS

The invention will be better understood by reference to the accompanying drawing, wherein.

DESCRIPTION OF THE PREFERRED EMBODIMENTS

Figure 1:
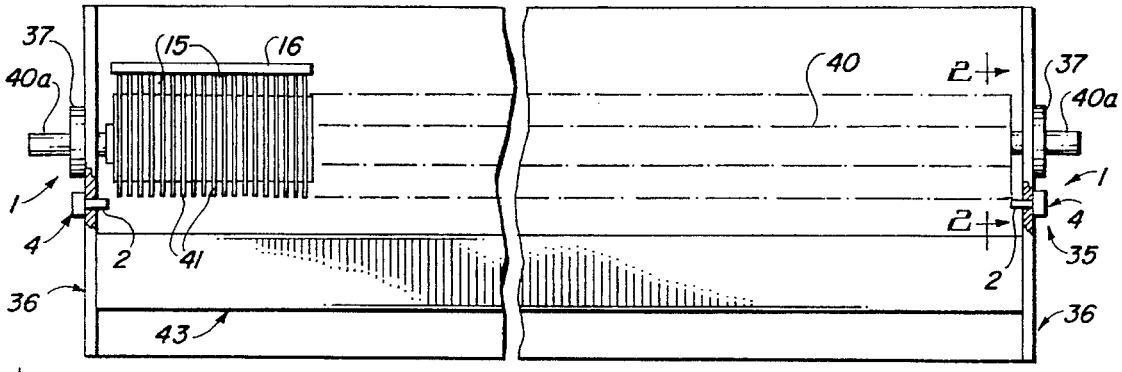
FIG. 1 is a front view, partially in section, of a typical embodiment of the gin stand heat detection apparatus of this invention, mounted in the main frame weldment of a conventional gin assembly and located adjacent to the saw cylinder assembly and the doffing roller.
Figure 2:
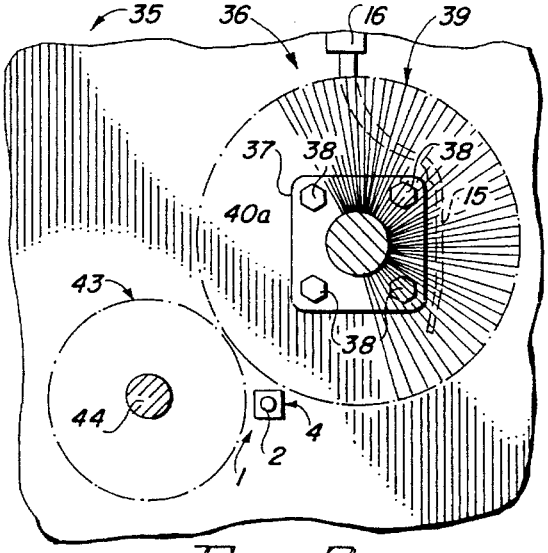
FIG. 2 is a side view, partially in section, of the main frame weldment, more particularly illustrating a typical mounting of one of the infrared thermocouples and companion mount and bracket to the main frame weldment.
Figure 3:
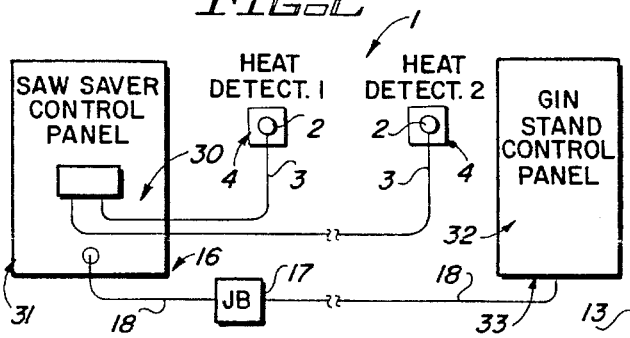
FIG. 3 is a schematic of a preferred embodiment of the gin stand heat detection apparatus, including the infrared thermocouples and associated wiring connecting the infrared thermocouples to the control panel and the control panel to the conventional gin stand control panel.
Figure 4:
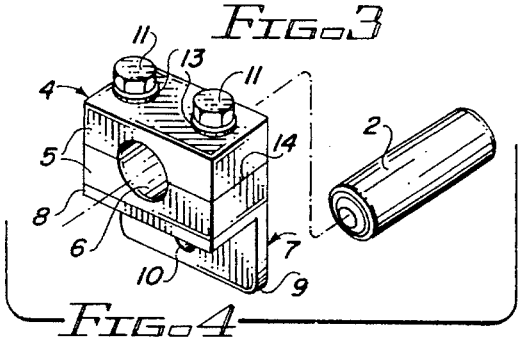
FIG. 4 is a perspective view of a typical infrared thermocouple and associated thermocouple mount and bracket for receiving and mounting each infrared thermocouple on the main frame weldment.
Figure 5:
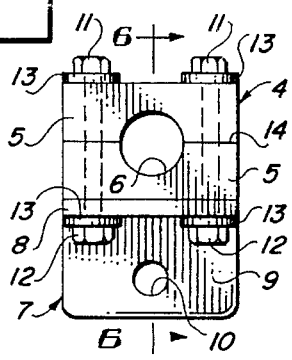
FIG. 5 is a front view of the thermocouple mount and bracket illustrated in FIG. 4.
Figure 6:
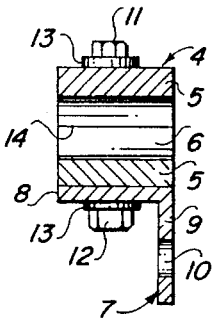
FIG. 6 is a sectional view taken along line 6—6 of the thermocouple mount and bracket illustrated in FIG. 5.

Referring initially to FIGS. 1–3 and 4–6 of the drawing, a preferred embodiment of the gin stand heat detection apparatus of this invention is generally illustrated by reference numeral 1. The gin stand heat detection apparatus 1 includes a pair of infrared thermocouples 2, each of which is fitted with thermocouple wiring 3 as illustrated in FIG. 3 and is seated in the cylindrical thermocouple receptacle 6 of a thermocouple mount 4. In a preferred embodiment of the invention each thermocouple mount 4 is characterized by a pair of mount segments 5, which fit together to define the thermocouple receptacle 6 along a match line 14, as illustrated in FIGS. 4–6. An "L-shaped" mount bracket 7 includes a base flange 8, which is seated against one of the mount segments 5 and a mount flange 9 extending from the base flange 8 in 90 degree relationship, with a mount flange opening 10 provided in the center of the mount flange 9. A pair of cap screws or bolts 11 are designed to extend through registering apertures (not illustrated) provided in the mount segments 5 and the base flange 8 of the mount bracket 7, as further illustrated in FIGS. 4–6. A pair of nuts 12 are threaded on the ends of the cap screws or bolts 11 and flat washers 13 are provided adjacent to the heads of the cap screws or bolts 11 and the nuts 12, as further illustrated in FIGS. 4–6 to securely, yet removably, attach the mount segments 5 to each other and the mount bracket 7 to the mount segments 5. The assembly of mount segments 5 and mount brackets 7 are then attached, typically by means of bolts (not illustrated) extending through the mount flange openings 10 to the main frame weldment 36 of the gin assembly 35 as illustrated in FIG. 1, such that the infrared thermocouples 2 are positioned in facing relationship with respect to each other along a line which is parallel to the mount axis of the assembled saw blades 41 in a saw cylinder assembly 39 and the longitudinal axis of the adjacent doffing roller 43. As further illustrated in FIG. 2, each of the thermocouple mounts 4 are positioned in close proximity to the doffing roller 43 and the fixed ginning ribs 15, which are mounted on a ginning rib mount 16, attached to the gin breast portion of the main frame weldment 36 and register with the respective saw blades 41 in conventional relationship, in order to separate the cotton seeds from the cotton during the ginning process. The doffing roller 43 is mounted on a doffing roller shaft 44 which is journalled for rotation in the main frame weldment 36, along with the cylinder shaft 40*a* of the saw cylinder 40, typically by means of a flange bearing 37, as illustrated in FIG. 2 with respect to the cylinder shaft 40*a*. Bearing bolts 38 serve to conventionally mount the flange bearing 37 on the main frame weldment 36, as further illustrated in FIG. 2.

Figure 7:
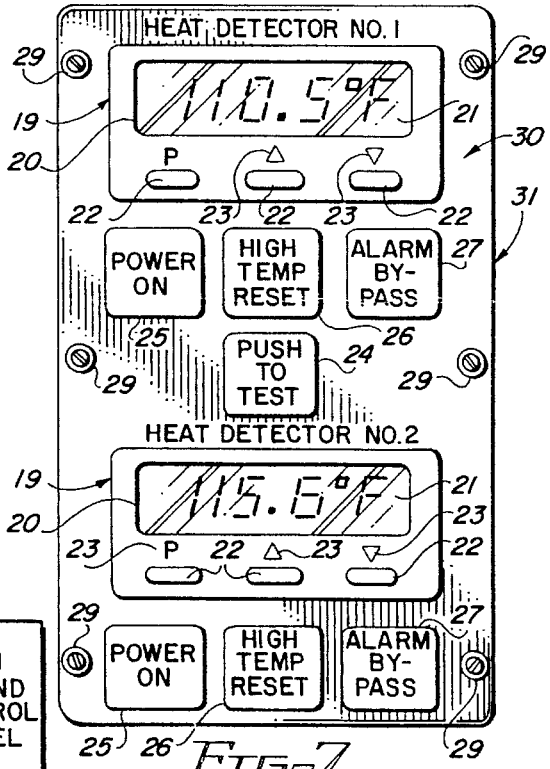
FIG. 7 is a front view of a typical control panel box and control devices associated with the respective infrared thermocouples illustrated in FIGS. 1 and 3.

Referring now to FIGS. 3 and 7 of the drawing, the infrared thermocouples 2, mounted in the respective thermocouple mounts 4, are electrically connected to a heat-sensing control panel 30 mounted in a heat-sensing control panel box 31 by means of thermocouple wiring 3. Furthermore, the heat-sensing control panel box 30 is, in turn, electrically connected to a gin stand control panel 32, mounted in a gin stand control panel box 33 and to a junction box 17, by means of junction box wiring 18, as illustrated in FIG. 3. The heat-sensing control panel 30 includes a pair of heat indicators 19, one for each of the infrared thermocouples 2, which provide a digital temperature indication of the temperature at the saw blades 41 and the associated fixed ginning ribs 15 illustrated in FIG. 1. The heat indicators 19 include a pair of temperature screens or displays 20 and indicate an illustrative base temperature 21 of 110.5° F., as well as the temperature sensed by both of the infrared thermocouples 2. A set of adjusting buttons 22 is also provided for each one of the infrared thermocouples 2 and the adjusting buttons 22 each include a button indicator 23 which may typically be a light-emitting diode. A "power on" button 25, "high temperature reset" button 26, "alarm bypass" button 27 and a "push to test" button 24 are also included in the heat-sensing control panel 30 for each of the infrared thermocouples 2. In a typical installation, control panel mount bolts 29 serve to mount the heat-sensing control panel box 31 and the gin stand control panel box 33 on a suitable frame or mount assembly (not illustrated).

In operation, and referring again to the drawing, the saw cylinder assembly 39 and doffing roller 43 are typically rotating in conventional fashion as illustrated in FIG. 1, with the gin breast closed in operating mode and the fixed ginning ribs 15 in place between the respective saw blades 41, to remove the cotton seed from the cotton in conventional fashion. If a cotton tag becomes lodged between a ginning rib 15 and a corresponding saw blade 41, then one or both of the infrared thermocouples 2 will "read" this temperature increase above the datum temperature of 110.5° F. displayed in the corresponding temperature screen 20 at the heat-sensing control panel 30. Accordingly, the operator may quickly determine which infrared thermocouple 2 is detecting the temperature increase and therefore, the approximate location of the "tag" in the saw cylinder assembly 39. Since the heat-sensing control panel 30 is connected to the gin stand control panel 32 by means of the wiring 18 and the junction box 17, the cotton gin can be quickly and automatically shut down by automatically backing the gin breast to the "out" position. Alternatively, appropriate steps can be taken by the gin operator to manually stop the saw cylinder 40 from rotating, remove the tag and thus eliminate the fire hazard.

Referring now to FIG. 7 of the drawing, the various control functions on the heat-sensing control panel 30 in the heat detection apparatus 1 are operated as follows. The "power-on" button 25 is illuminated by a light-emitting diode and is pressed to power-up the gin stand heat detection apparatus 1. The "power-on" light (not illustrated) will be illuminated if power is available. The "high temperature reset" button 26 is also illuminated by a light-emitting diode (not illustrated) and is used to reset the system after a high temperature alarm condition and gin shut-down have occurred. Accordingly, the high temperature reset button 26 is used to reset the alarm condition and the gin stand heat detection apparatus 1 will not reset until the sensor temperature 21 displayed on the temperature screen 20 is below the preset alarm temperature. The "alarm bypass" button 27 is likewise provided with a light-emitting diode (not illustrated) and is used to indicate that the gin stand heat detection apparatus 1 is bypassed from operation of the cotton gin and will therefore not operate to shut down the cotton gin by operation of the gin stand control panel 32. However, under ordinary circumstances, the heat-sensing control panel 30 is connected to the gin stand control panel 32 by means of the junction box wiring 18 and junction box 17 to facilitate automatically moving the gin breast to the "out" position and terminating operation of the various components of the cotton gin and gin assembly 35, under circumstances where a high temperature condition exists somewhere in the saw blades 41 and the ginning ribs 15. As described above, the "alarm bypass" button 27 serves to bypass this safety feature and facilitate manual or automatic operation of the cotton gin, including the gin assembly 35, without regard to the gin stand heat detection apparatus 1. The "push to test" button 24 is non-illuminated and is a momentary contact push button which causes the gin breast (not illustrated) in the cotton gin to move to the "out" position and facilitate visual testing of the gin stand heat detection apparatus 1 by the operator.

Accordingly, in a typical start-up procedure the "alarm bypass" switch 27 is pressed to the "in", illuminated position to isolate the gin stand heat detection apparatus 1 from the gin stand control panel 32 and the "power-on" button 25 is then pressed, allowing the gin stand heat detection apparatus 1 to warm up for about fifteen minutes. Under these conditions the "power-on" control button 22*a* should-be illuminated. The alarm temperature 21 on the temperature screen 20 is then set by pressing the center "up" adjusting button 22 and adjusting the alarm temperature 21 to the desired danger level, which is typically about two degrees above operating temperature for the gin assembly 35. The "alarm bypass" button 27 is then pressed such that the alarm bypass switch light is extinguished, to place the gin stand heat detection apparatus 1 "on line" and in control of the gin stand control panel 32. The left-hand control button 22, marked "P", is then pressed to display the alarm temperature 21 on the temperature screen 20 and the up and down keys 22 are then used to raise or lower the temperature setting of the temperature 21 on the temperature screen 20 in a final adjustment. The system is now ready to detect "hot spots" in the saw blades 41 and corresponding ginning ribs 15.

It will be appreciated by those skilled in the art that the gin stand heat detection apparatus 1 of this invention can be installed in substantially any conventional cotton gin in order to detect "hot spots" along the entire length of the saw cylinder assembly. Furthermore, installation is quick and easy using the thermocouple mounts 4 and associated mount brackets 7, as the infrared thermocouples 2 are positioned in facing relationship between the saw cylinder assembly 39 and the doffing roller 43, as illustrated in FIGS. 1 and 2. Since the gin stand control panel 32 is already in place, it remains only to mount the heat-sensing control panel 30 in a desired location and attach the appropriate junction box wiring 18, which joins the heat-sensing control panel 30 to the gin stand control panel 32 by means of the junction box 17 and place the gin stand heat detection apparatus 1 "on line" in the cotton gin.

While various types of infrared thermocouples can be used in the gin stand heat detection apparatus of this invention, in a preferred embodiment, thermocouples sold by Exergen, Inc of Newton, Mass. as IR TC Model J-140, are particularly useful for the application of this invention.

While the preferred embodiments of this invention have been described above it will be recognized and understood that various modifications may be made in the invention and the appended claims are intended to cover all such modifications which may fall within the spirit and scope of the invention.

Having described my invention with the particularity set forth above, what is claimed is:

1. A heat detection apparatus for a cotton gin having saw blades and ginning ribs, comprising a pair of infrared thermocouples mounted in the cotton gin in spaced, facing relationship with respect to each other for detecting a temperature rise in the cotton gin in close proximity to the blades and ribs.

2. The heat detection apparatus of claim 1 comprising mount means for receiving said infrared thermocouples, said mount means engaging the cotton gin and mounting said infrared thermocouples on the cotton gin.

3. The heat detection apparatus of claim 1 comprising control means electrically connected to said infrared thermocouples for displaying the temperature rise in the cotton gin and terminating operation of the cotton gin.

4. The heat detection apparatus of claim 3 wherein said control means comprises a thermocouple control panel and a first set of temperature controls mounted in said thermocouple control panel, with said first set of temperature controls electrically connected to one of said pair of infrared thermocouples and a second set of temperature controls mounted in said thermocouple control panel, with said second set of temperature controls electrically connected to the other of said pair of infrared thermocouples.

5. The heat detection apparatus of claim 4 comprising mount means for receiving said infrared thermocouples, said mount means engaging the cotton gin and mounting said infrared thermocouples on the cotton gin.

6. A heat detection apparatus for mounting in the gin stand weldment of a cotton gin adjacent to the saw blades of the saw cylinder assembly and the ginning ribs of the cotton gin, said heat detection apparatus comprising a pair of infrared thermocouples mounted in facing, spaced relationship with respect to each other in said gin stand weldment at the saw cylinder assembly for monitoring the temperature of the saw blades and the ginning ribs.

7. The heat detection apparatus of claim 6 comprising control means electrically connected to said infrared thermocouples for displaying and monitoring the temperature of the saw blades and the ginning ribs and terminating operation of the cotton gin at a predetermined temperature of the saw blades and the ginning ribs.

8. The heat detection apparatus of claim 7 wherein said control means comprises a thermocouple control panel, a first set of temperature controls provided on said thermocouple control panel and electrically connected to one of said pair of infrared thermocouples and a second set of temperature controls provided on said thermocouple control panel and electrically connected to the other of said pair of infrared thermocouples.

9. The heat detection apparatus of claim 6 comprising a pair of bracket means mounted in the gin stand weldment in spaced relationship with respect to each other and wherein said infrared thermocouples are mounted in said bracket means, respectively.

10. The heat detection apparatus of claim 9 comprising control means electrically connected to said infrared thermocouples for displaying and monitoring the temperature of the saw blades and the ginning ribs and terminating operation of the cotton gin at a predetermined temperature of the saw blades and the ginning ribs.

11. The heat detection apparatus of claim 10 wherein said control means comprises a thermocouple control panel, a first set of temperature controls provided on said thermocouple control panel and electrically connected to one of said pair of infrared thermocouples and a second set of temperature controls provided on said thermocouple control panel and electrically connected to the other of said pair of infrared thermocouples.

12. A heat detection apparatus for detecting a temperature rise in the saw blades and ginning ribs in the gin stand of a cotton gin having a cotton gin control system, said heat detection apparatus comprising a pair of infrared thermocouples mounted in the gin stand in facing relationship with respect to each other and facing along a detection line disposed substantially parallel to the axis of rotation of the saw blades, whereby said infrared thermocouples operate to sense said temperature rise in the saw blades and ginning ribs.

13. The heat detection apparatus of claim 12 comprising control means electrically connected to said infrared thermocouples and the cotton gin control system for displaying and monitoring the temperature of the saw blades and ginning ribs and terminating operation of the cotton gin at a predetermined temperature rise in the saw blades and ginning ribs.

14. The heat detection apparatus of claim 13 wherein said control means comprises a thermocouple control panel, a first set of temperature controls provided on said thermocouple control panel and electrically connected to one of said pair of infrared thermocouples and a second set of temperature controls provided on said thermocouple control panel and electrically connected to the other of said pair of infrared thermocouples.

15. The heat detection apparatus of claim 12 comprising a pair of brackets mounted on the gin stand and wherein said infrared thermocouples are mounted in said brackets, respectively.

16. The heat detection apparatus of claim 15 comprising control means electrically connected to said infrared thermocouples for displaying and monitoring the temperature of the saw blades and ginning ribs and terminating operation of the cotton gin at a predetermined temperature of the saw blades and ginning ribs.

17. The heat detection apparatus of claim 16 wherein said control means comprises a thermocouple control panel, a first set of temperature controls provided on said thermocouple control panel and electrically connected to one of said pair of infrared thermocouples and a second set of temperature controls provided on said thermocouple control panel and electrically connected to the other of said pair of infrared thermocouples.

18. The heat detection apparatus of claim 14 wherein said first set of temperature controls and said second set of temperature controls each comprise a temperature indicator provided on said control panel, adjustment means for adjusting the temperature in said temperature indicator provided on said control panel, and a "power on" button for powering said infrared thermocouples and said temperature indicator, a "temperature reset" button for adjusting the temperature in said temperature indicator, an "alarm bypass" button and a "push test" button for bypassing and testing said temperature controls, provided on said control panel.

* * * * *